US012258835B1

(12) United States Patent
Karakaya

(10) Patent No.: US 12,258,835 B1
(45) Date of Patent: Mar. 25, 2025

(54) SEPARABLE LUBRICATOR SYSTEM

(71) Applicant: Saudi Arabian Oil Company, Dhahran (SA)

(72) Inventor: Mustafa Karakaya, Izmir (TR)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/624,879

(22) Filed: Apr. 2, 2024

(51) Int. Cl.
*E21B 33/068* (2006.01)

(52) U.S. Cl.
CPC ..... *E21B 33/068* (2013.01)

(58) Field of Classification Search
CPC ..... E21B 33/068
See application file for complete search history.

(56) References Cited

U.S. PATENT DOCUMENTS 2,250,244 A * 7/1941 Yancey ..... E21B 33/068 29/213.1
2,358,677 A * 9/1944 Yancey ..... E21B 33/03 166/85.4
2,517,870 A * 8/1950 Gump ..... E21B 34/02 166/85.1
4,019,541 A * 4/1977 Koppl ..... E21B 33/068 138/94
4,248,265 A * 2/1981 Freeman, Jr. ..... E21B 33/068 137/512.1
4,460,039 A * 7/1984 Knight ..... E21B 34/02 166/85.4
11,530,592 B2 * 12/2022 Perschke ..... E21B 19/086
2012/0024521 A1 * 2/2012 Villa ..... E21B 33/068 166/75.11
2017/0275977 A1 * 9/2017 Varela ..... E21B 33/068
2021/0285302 A1 * 9/2021 Dalinger ..... E21B 33/072
2022/0081989 A1 3/2022 Muballa et al.
2022/0120155 A1 4/2022 Firth et al.
2024/0191600 A1 * 6/2024 Karakaya ..... E21B 37/00

OTHER PUBLICATIONS

U.S. Appl. No. 18/479,451, Karakaya, Maintaining a Tubing Hanger Profile, filed Oct. 2, 2023, 18 pages.

* cited by examiner

*Primary Examiner* — Aaron L Lembo
(74) *Attorney, Agent, or Firm* — Fish & Richardson P.C.

(57) ABSTRACT

A pressure containment device includes a separable lubricator housing, a lubricator rod with a polished section and a non-polished section, and a pressure valve. The separable lubricator housing includes a barrel and a yoke releasably connected to the barrel. The yoke has an aperture defining an axis and the barrel has an interior bore centered on the axis. The lubricator rod is slidably arranged on the axis and extends from a first end arranged in the interior bore to a second end extending out the aperture of the yoke. The non-polished section is arranged in the interior bore of the barrel. The pressure valve is mounted to the second end of the lubricator rod.

23 Claims, 10 Drawing Sheets

SEPARABLE LUBRICATOR SYSTEM

TECHNICAL FIELD

This disclosure relates to pressure containment systems in the oil and gas industry, and more particularly to back pressure valve and two-way check valve pressure containment systems.

BACKGROUND

Lubricators are used in downhole operations to manage well pressure when it becomes necessary to access the pressurized well. A lubricator acts as a "pressure lock" via which tools may be inserted into and retrieved from a well which is under pressure. A lubricator may be supported in a derrick or from a crane jib. Lubricators are fitted to the top of a wellhead (e.g. a "Christmas tree" or production tree) so that various items and down-hole tools can be inserted into a high-pressure oil or gas (or other) well.

The top of the lubricator assembly features a high-pressure section and sealing components. The tool(s) to be placed into the well are placed in the lubricator. The lubricator is temporarily installed upon the "tree" and tested. After testing, lubricator valve(s) are opened to equalize to wellbore pressure. The top valves of the "tree" are then opened to allow the tools to run in (or be pumped by hydraulic pressure) down the bore. Removal of the down-hole tool(s) is accomplished by the reverse process. To remove a tool, the tool is pulled up the bore and into the lubricator under wellbore pressure, the tree valves are closed, and the wellbore pressure within the lubricator is bled off. After the high pressure in the lubricator is safely released, the lubricator can be opened.

SUMMARY

In certain aspects, a pressure containment device includes a separable lubricator housing, a lubricator rod, and a pressure valve. The separable lubricator housing includes a barrel defining an interior bore extending from a proximal end of the barrel to a distal end of the barrel and a yoke defining an aperture extending from a proximal end of the yoke to a distal end of the yoke. The aperture defines an axis. The interior bore of the separable housing is centered on the axis. The proximal end of the yoke is releasably connected to the distal end of the barrel. The lubricator rod is slidably arranged on the axis in the interior bore of the barrel and in the aperture of the yoke. The lubricator rod extends from a first end arranged in the interior bore to a second end extending out the aperture of the yoke. The lubricator rod has a polished section and a non-polished section. The non-polished section is arranged in the interior bore of the barrel. The pressure valve is mounted to the second end of the lubricator rod.

In some devices, the non-polished section extends from the first end of the lubricator rod.

In some devices, the non-polished section is arranged between the first end and the second end of the lubricator rod.

In some embodiments, the non-polished section can include a textured surface. The textured surface is can be a thread.

Some devices also includes a nut arranged on the non-polished section. The nut can be rotationally coupled to the lubricator rod. Some nuts are configured to engage a torque generator.

In some devices, non-polished section includes an engagement body and the engagement body extends radially from a textured surface of the non-polished section. The engagement body can be configured to engage a torque generator.

In some embodiments, the polished section of the lubricator rod is a first polished section. The lubricator rod can include a second polished section. The non-polished section can be arranged between the first polished section and the second polished section.

In some devices, the barrel and the yoke are releasably connected by ACME threads.

The pressure valve can be a back-pressure valve or a two way check valve.

In certain aspects, a pressure containment system includes a lubricator device and a lubricator rod. The lubricator includes a housing having a barrel and a yoke. The barren defines an interior bore extending from a proximal end of the barrel to a distal end of the barrel. The yoke defines an aperture extending from a proximal end of the yoke to a distal end of the yoke. The aperture defines an axis and the interior bore is centered on the axis. The proximal end of the yoke is mounted to the distal end of the barrel. The system also includes a lubricator rod slidably arranged on the axis in the interior bore of the barrel and in the aperture of the yoke. The lubricator rod extends from a first end arranged in the interior bore to a second end extending out the aperture of the yoke. The lubricator rod has a polished section and a non-polished section. The non-polished section is radially aligned with the interior bore of the barrel. The system also has a pressure valve mounted to the second end of the lubricator rod.

In some systems, the proximal end of the yoke is releasably connected to the distal end of the barrel. The lubricator housing can have an open position and a closed position. In the closed position, the distal end of the barrel and the proximal end of the yoke can be engaged. In the open position, the distal end of the barrel and the proximal end of the yoke can be disengaged. In some systems, the barrel is axially distanced from the yoke in the open position of the lubricator housing. In the open position, the non-polished section of the lubricator rob can be exposed.

In some lubricator devices, the distal end of the barrel defines a first ACME thread and the proximal end of the yoke defines a second ACME thread. The first ACME thread and the second ACME thread can be releasably mated.

The system can also include a torque generator that engages the non-polished section of the lubricator rod.

The system can further include a nut mounted on the non-polished section of the lubricator rod. The nut can be aligned with the interior bore of the barrel. Some nuts are releasably mounted on threads defined in the non-polished section of the lubricator rod.

Some systems include a production tree having a tubing hanger and a well head. The production tree can be attached to the lubricator housing.

Some systems also include a needle valve arrangement with a pressure tubing extending from the distal end of the yoke to the proximal end of the yoke and at least one needle valve disposed on the pressure tubing. The at least one needle valve is operable to isolate the distal end of the yoke from the proximal end of the yoke when the lubricator housing is in the open position.

In certain aspects, a method includes applying torque to a non-polished section of a lubricator rod of a lubricator.

Some methods also include, prior to applying torque to the non-polished section of the lubricator rod of the lubricator, exposing the non-polished section of the lubricator rod. In some methods, exposing the non-polished section of the lubricator rod includes disengaging a barrel of a lubricator housing of the lubricator from a yoke of the lubricator housing of the lubricator.

In some embodiments, the method includes stopping the application of torque and covering the non-polished section of the lubricator rod. Covering the non-polished section of the lubricator rod can include connecting a barrel of a lubricator housing of a lubricator to a yoke of the lubricator housing of the lubricator. The barrel has an interior bore. The interior bore can receive at least a portion of the non-polished section of the lubricator rod.

Separable lubricator systems include a separable housing and lubricator rob to set and retrieve different valves (e.g., a back-pressure valves (BPVs) system or a two-way check valves (TWCVs) using standard operating techniques. Should a set valve become stuck, the separable housing can be separated to expose a non-polished portion of the lubricator rod. The lubricator rod is position to engage with a torque generator (e.g., a torque wrench) which applies torque to the rod to remove the stuck valve.

The separable pressure containment system can reduce or prevent expensive mitigation operations or procedures needed to remove stuck BPVs in tubing hangers. For example, the separable housing of the pressure containment system and exposed, non-polished lubricator rod could reduce the need to mill out the BPV from the tubing hanger, reduce workover and/or drill rig intervention operations to retrieve the BPV/TWCV after killing the well or milling, reduce the need for hot tapping, and reduce the need to pump kill fluid to use dry rod for retrieving the BPV/TWCV. The separable pressure containment system can increase success rate of the BPV-TWCV set and retrieve operations for oil and gas wells.

The details of one or more embodiments are set forth in the accompanying drawings and the description below. Other features, objects, and advantages will be apparent from the description and drawings, and from the claims.

BRIEF DESCRIPTION OF DRAWINGS

Like reference symbols in the various drawings indicate like elements.

DETAILED DESCRIPTION

This disclosure relates to a pressure containment system, for example a back-pressure valve (BPV) system or a two-way check valve (TWCV) system, for dislodging a stuck or clogged pressure isolator (e.g., a pressure valve, two-way check valve, back-pressure valve). The pressure containment system is deployed to isolate a well or high-pressure zone of a well so that high pressures (e.g., between 0 psi to 15,000 psi, inclusive) are maintained in the isolated well or zone. The pressure containment systems, can be used, for example, as a permanent, semi-permanent barrier, or as a temporary barrier to isolate a well or a portion of the well (a first zone of the well). Temporary isolation operations include, for example, replacing a production tree (Christmas tree, tree) or master valves in a nipple up and/or down-installation and/or removal operation. The pressure containment system can be manually or hydraulically powered.

In use, an isolator or pressure valve of the system is arranged in a tubing hanger of the production tree and forms a contact seal with an internal profile of the tubing hanger. The pressure valve is rotatable relative to the tubing hanger. The seal between the pressure valve and the tubing hanger is maintained when the pressure valve is rotated relative to the tubing hanger. BPV/TWCV and tubing hanger can be decoupled and the seal disengaged by axially distancing the pressure valve from the tubing hanger (for example in a first, uphole direction). The lodged debris prevents axial and rotational movement of the pressure valve relative to the tubing hanger. BPV/TWCV could become stuck in the tubing hanger of the wellhead when debris is lodged between the pressure valve and the tubing hanger. In some instances, additional rotational force required to rotate the BPV/TWCV in the tubing hanger profile.

To dislodge the pressure valve from the debris, the pressure containment system can separate a housing to expose a lubricator rod connected to the pressure valve. The lubricator rod connects to an external torque generator (e.g., a high power wrench) and transfer a high amount of torque (e.g., about 1,000 ft-lbs to about 20,000 ft-lbs) to the pressure valve. The torque force overcomes the static frictional force from the debris and severs a connection between the debris and the pressure valve. The pressure containment system then disengages the torque generator, unites the separated housing, and operates normally to axially distance the unstuck pressure valve form the tubing hanger.

Figure 1:
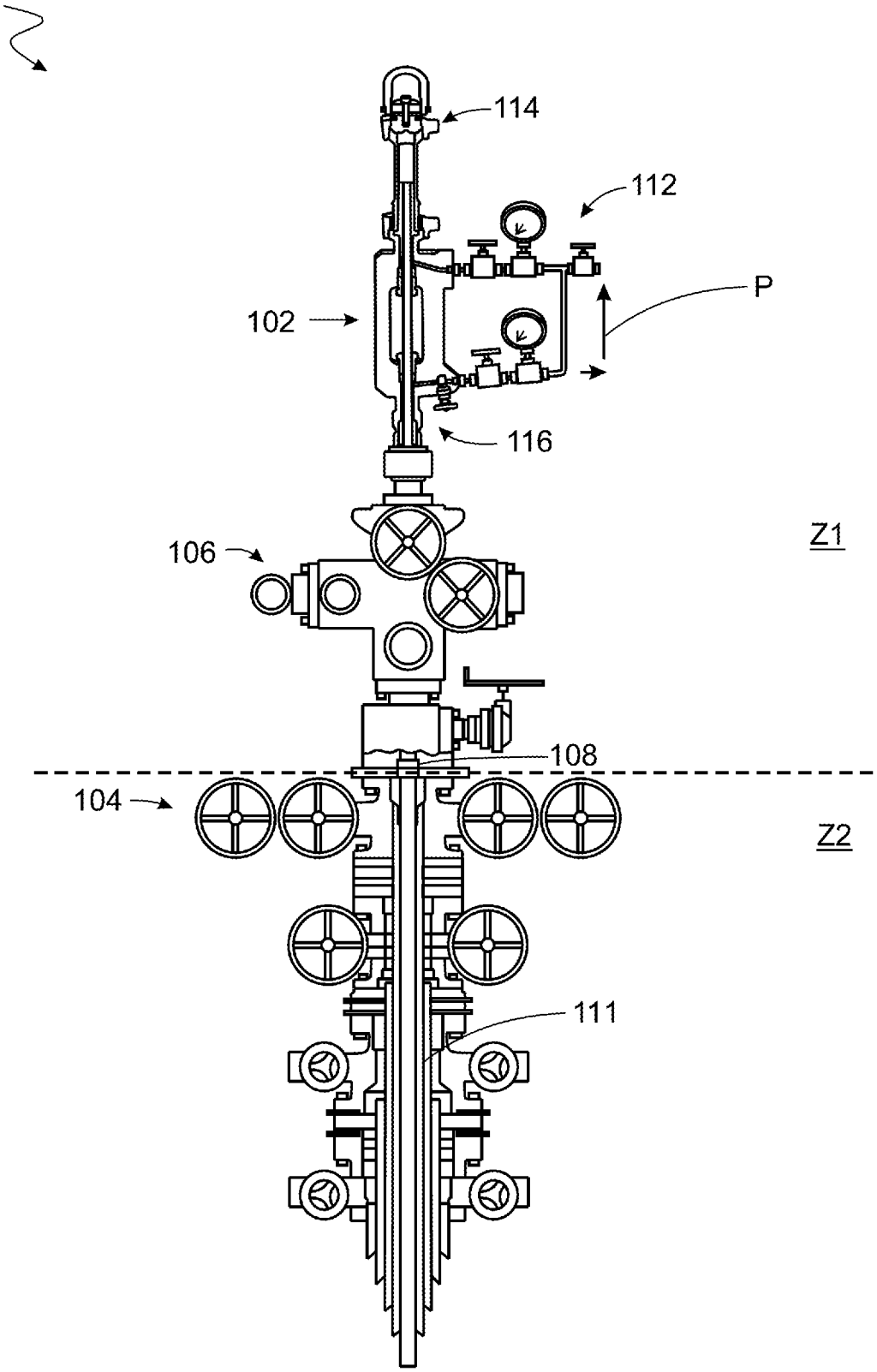
FIG. 1 is a front view of a pressure containment system having a pressure containment device.

FIG. 1 is a front view of a pressure containment system (lubricator system) 100 having a pressure containment device (lubricator) 102 connected to a production tree 104. The pressure containment device 102 can be a lubricator, for example a PBV lubricator or a TWCV lubricator. The pressure containment system 100 (lubricator system) defines a first pressure zone Z1 between a wellhead 106 of the production tree 104 and a tubing hanger 108 of a production tree 104. A second pressure zone Z2 is defined between the tubing hanger 108 and a wellbore casing 111 connected to the tubing hanger 108. The tubing hanger 108 can engage with a pressure valve 122 (FIG. 2) of the lubricator 102 The pressure containment system 102 is mounted to a production tree 104. At least one portion of the lubricator 102 moves axially to engage and/or disengage the tubing hanger 108 of the production tree 104. When engaged, the pressure containment system 100 isolates a casing/tubing 111 connected to or part the wellhead 106. The tubing hanger 108 is part of a wellhead equipment 106. The lubricator 102 can contain pressures of up to 15,000 psi, 10,000 psi, 20,000 psi on at least one side of the pressure containment device 102. Some pressure containment devices hold high pressures on both sides (e.g., using a two-way check valve).

Figure 2:
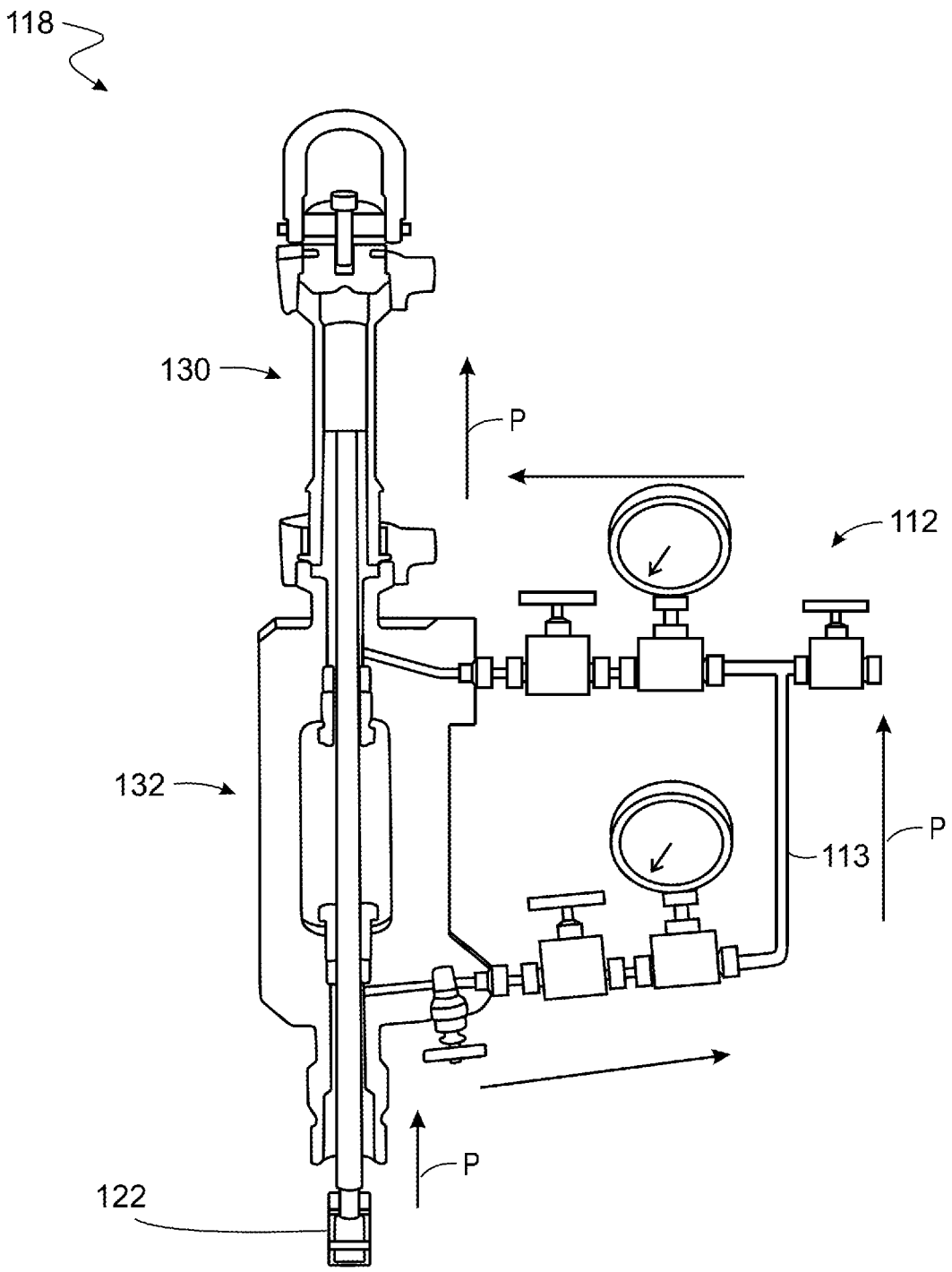
FIG. 2 is a cross-sectional view of the pressure containment device having a separable housing, a rod, and a pressure valve.

FIG. 2 is a cross-sectional front view of the pressure containment device 102 (lubricator). The lubricator 102 includes a needle valve arrangement 112. The needle valve arrangement may equalize and/or bleed off pressure in the lubricator 102. The needle valve arrangement 112 includes several needle valves and a pressure gauges. Some needle valve arrangements can include more than four needle valves, less than four needle valves, or valves different from needle valves. In some cases, the needle valve arrangement can create a third pressure. In such a configuration, the second pressure zone extends from the pressure valve to a needle valve in the needle valve arrangement and the third pressure zone extends from the needle valve in the needle valve arrangement at least to the first end of the lubricator. The needle valve arrangement 112 can receive and guide pressure P from the well head 110 to a barrel of the lubricator housing to equalize a pressure at the first end 114 of the lubricator 102 and a second end 116 of the lubricator 102. The needle valve arrangement 112 includes pressure tubing 113 connecting the needle valves and pressure gauges.

The lubricator 102 includes a separable lubricator housing 118, a lubricator rod 120 arranged in the lubricator housing 118, and a pressure valve 122 (e.g., a BPV 122 or TWCV) mounted on the lubricator rod 120. The pressure valve 122 is axially and rotationally constrained to the rod 120. The rod 120 is movable within the lubricator housing 118 along an axis. In use, the lubricator housing 118 can be separated so that the rod 120 can engaged an external force generator, receive a torque force from the connectable torque generator, and transfer the torque force to the to the pressure valve 122. The torque force applied to the pressure valve via the rod can be about 200 feet per pound (ft/lbs) to about 20,000 ft/lbs (e.g., about 300 ft/lbs to about 20,000 ft/lbs).

Figure 3A:
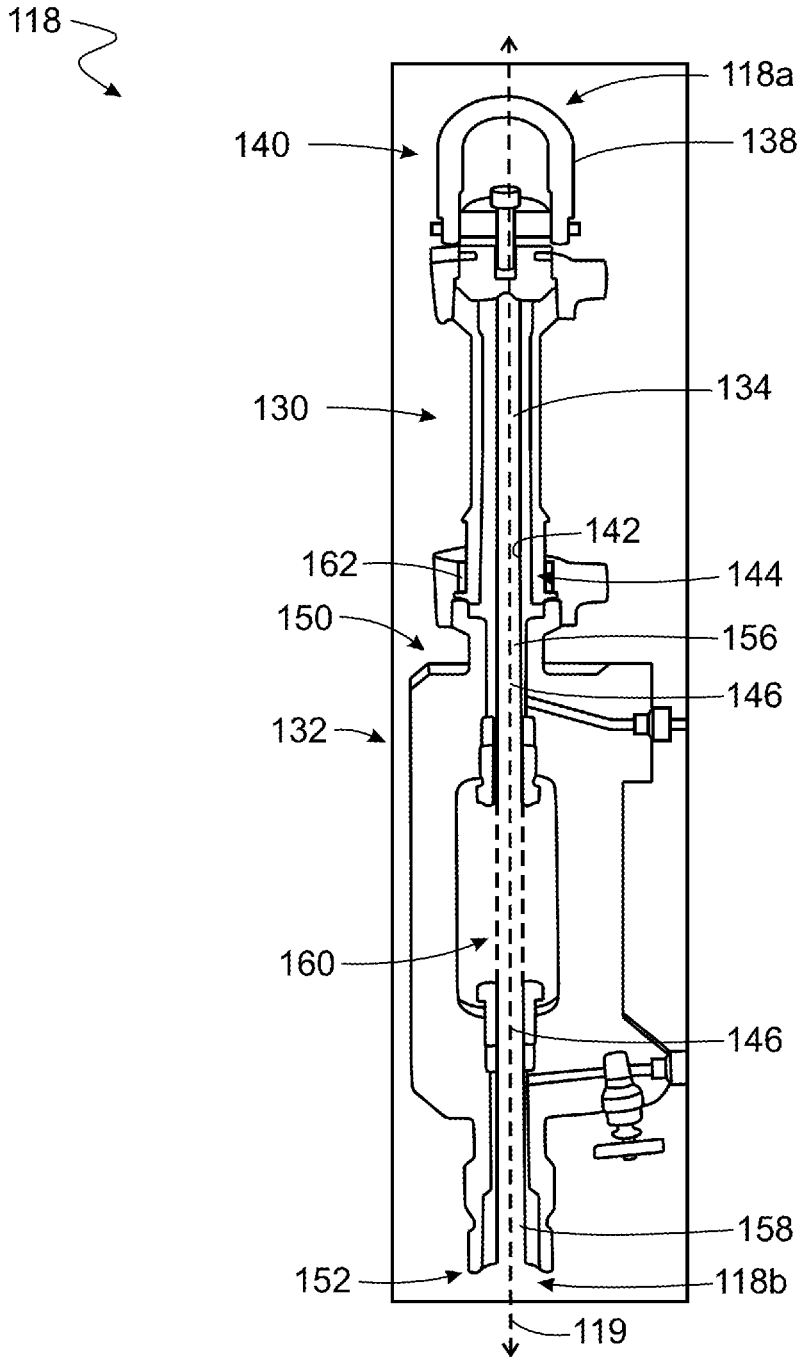
FIGS. 3A and 3B are cross-sectional view of the separable housing in a closed position and an open position respectively.
Figure 3B:
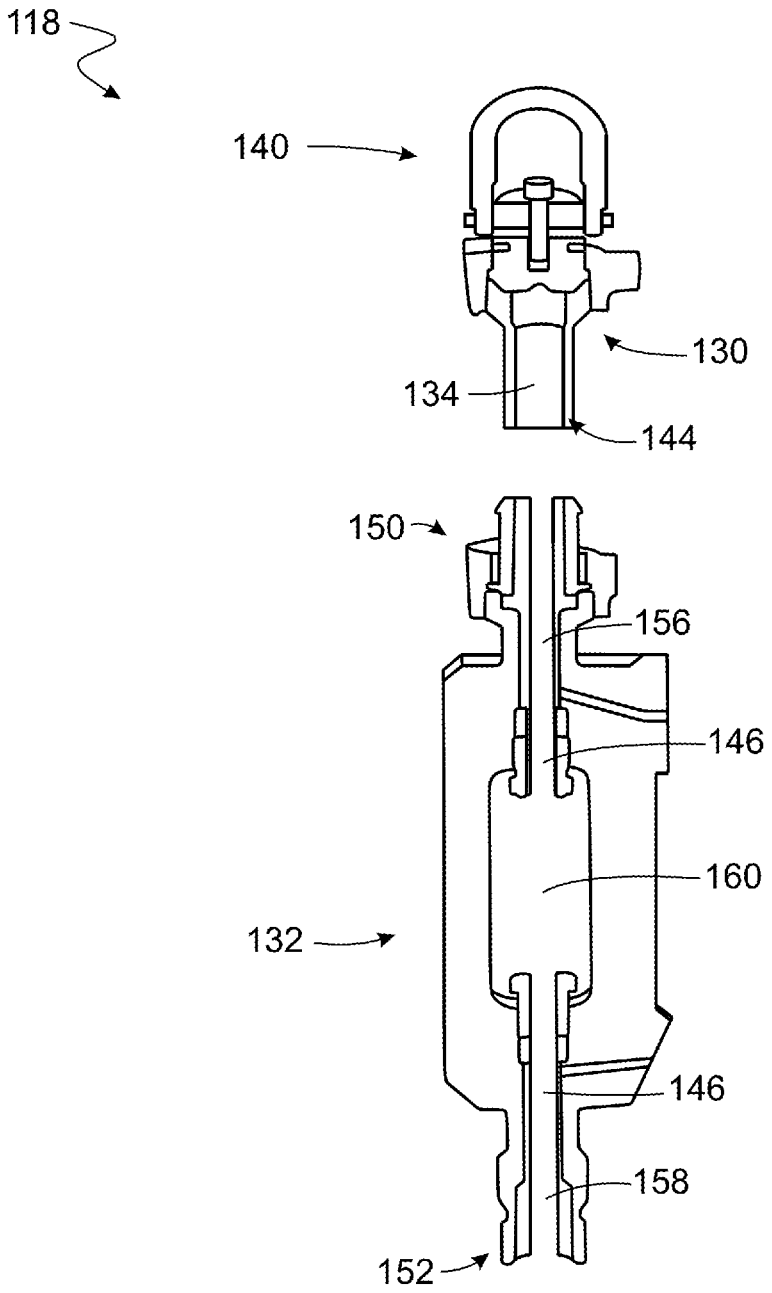

FIGS. 3A and 3B are cross-sectional front views of a separable lubricator housing 118 of the lubricator 102 in a closed position and an open position, respectively. The lubricator housing 118 extends from a first end 118*a* of the lubricator housing 118 to a second end 118*b* of the lubricator housing 118. The first end 118*a* and second end 118*b* of the lubricator housing 118 define an axis 119.

The lubricator housing 118 includes a barrel (first portion) 130 extending from the first end 118*a* and a yoke 132 (second portion) extending from the second end 118*b*. The barrel 130 and yoke 132 are centered on the axis 119. The barrel 130 is releasably connected to the yoke 132 by an ACME threaded connection 144. In the closed position, the barrel 130 and the yoke 132 are connected and able to contain a pressure. In the open position, the barrel 130 and the yoke 132 are disengaged and axially distanced from each other. The lubricator rod 120 extends from the barrel 130, though the yoke 132, and wellhead 110, when the lubricator 102 is connected to a production tree 104. In the open position, at least a portion of the yoke 132 is exposed to environmental pressure.

The barrel 130 defines an interior bore 134 (hollow cavity or channel) centered on the axis 119 when the lubricator housing 118 is in the closed position (FIG. 3A). The interior bore 134 receives and retains a portion of the lubricator rod 120 in the closed position. The lubricator rod 120 is movable along the axis 119 within the interior bore 134. The barrel 130 includes an eye 138 or hook on a first end 140 of the barrel 130 and an ACME thread 142 at a second end 144 of the barrel 130. The second end 144 of the barrel 130 engages and disengages with the yoke 132 to cover and/or expose an internal aperture 146 of the yoke 132. The eye 138 receives or connects to lifting and alignment machinery (not shown). The alignment machinery (not shown) can position the lubricator on the wellhead and can separate the barrel form the yoke.

The yoke 132 of the lubricator housing 118 includes a barrel (first) end 150 connectable to the barrel 130 and a wellhead (second) end 152 connectable to the wellhead 110. The connection between the wellhead 110 and the yoke 132 may be threaded, flanged, or a combination thereof. The yoke 132 defines a yoke aperture 146. The connection between the barrel end 150 of the yoke 132 and the barrel 130 is an ACME threaded connection (e.g., a hand tightened ACME threaded connection). The yoke defines the yoke aperture 146 which extends from the barrel end 150 of the yoke 132 to the wellhead end 152 of the yoke 132. The aperture is centered on the axis 119 and (axially) aligned with the interior bore 134 of the barrel 130 (e.g., aligned along the axis). The aperture 146 is sized to receive the lubricator rod 120. The lubricator rod 120 is slidably arranged in the yoke aperture 146 in the open position (FIG. 3A) and in the closed position (FIG. 3B). In this configuration the first end 118*a* can detach from the second end 118*b* of the lubricator housing 118. Prior to separation, the needle valve arrangement 112 isolates the first end 118*a* from the second end 118*b* such that pressure in the first end 118*a* can be bled off while the pressure in the second end 118*b* remains constant (e.g., remains at a high pressure).

The yoke aperture 146 includes a first cavity 156 (first channel) and a second cavity 158 (second channel). The first cavity 156 is arranged on the barrel end 150 of the yoke 132 and the second cavity 158 is arranged on the wellhead end 152 of the yoke 132. The first and second cavities 156, 158 are separated by a window 160 defined in the yoke 132. The window 160 provides access to a portion of the lubricator rod 120 (radially) aligned with the window 160. The section of the lubricator rod exposed by the window can be manually manipulated, for example by a manual gripping tool (e.g., a parmalee wrench or strap wrench). The window 160 has a length of about 1 ft to about 2 ft and a width of about 2 to about 6. Seals 159 (e.g., scaling elements) are mounted to the first cavity 156 and second cavity 158. The seals 159 contact or mate with the lubricator rod 120 to form a pressure seal. Some seals are mounted in walls of the yoke such that the first and second cavities are at least partially defined by the seals and inner walls of the yoke. The seals can form a pressure seal of up to 15,000 psi. The seals can maintain the pressure seal when the lubricator rod translates axially (e.g., along the axis) and when the lubricator rod rotates on the axis.

The interior bore 134 of the barrel 130 is centered on the axis 119 when the barrel 130 is connected to the yoke 132. The first cavity 156 extends from the barrel end 150 to the window 160. The second cavity 158 extends from the window 160 to the wellhead end 152 of the yoke 132.

In some cases, the window forms a third cavity between the first and second cavities. The first cavity and second cavity are axially aligned with the axis. In some cases, the first and second cavities of the yoke define the axis. In some lubricator housings, the interior bore, the first cavity, the window, the second cavity, and/or a combination thereod form a rod channel of the lubricator housing.

Figure 4:
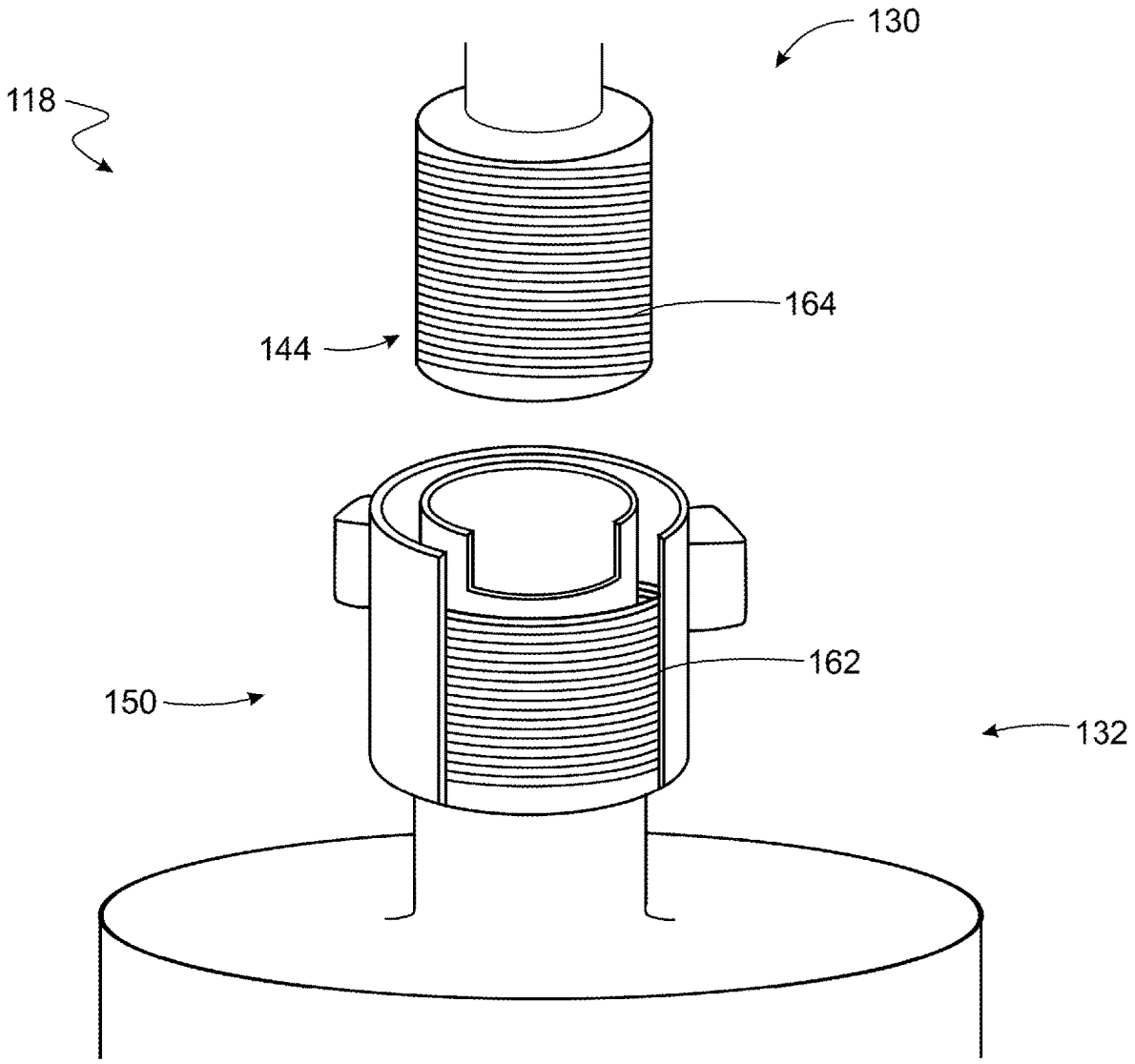
FIG. 4 is a cross-sectional view of the connection between a first portion of the housing and a second portion of the housing.

FIG. 4 is a perspective, exploded, cross-sectional view of the ACME connection between the barrel 130 and yoke 132 of the lubricator housing 118. The barrel 130 is releasably connected to the yoke 132 by the ACME threaded connection (a first set of ACME connectors). The ACME connection (e.g., a hand tight 4TPI-2G ACME Threaded connection) occurs when a first ACME thread 162 on the on the barrel end 150 of the yoke engages with a second ACME thread 164 on the second end 144 of the barrel 130. The first and second ACME threads 162, 164 form seals that can disconnect and re-connect without using hammer or applying high torques (e.g., torques over 1,000 ft/lbs). Hand tight, ACME connections can maintain a seal of up to about 15,000 psi. The lubricator may also include a second set of ACME threads to connect the lubricator housing to the production tree. The barrel end 150 is shown as integral to the yoke 132, however, some barrel ends connect to the yoke by a flange.

Figure 5:
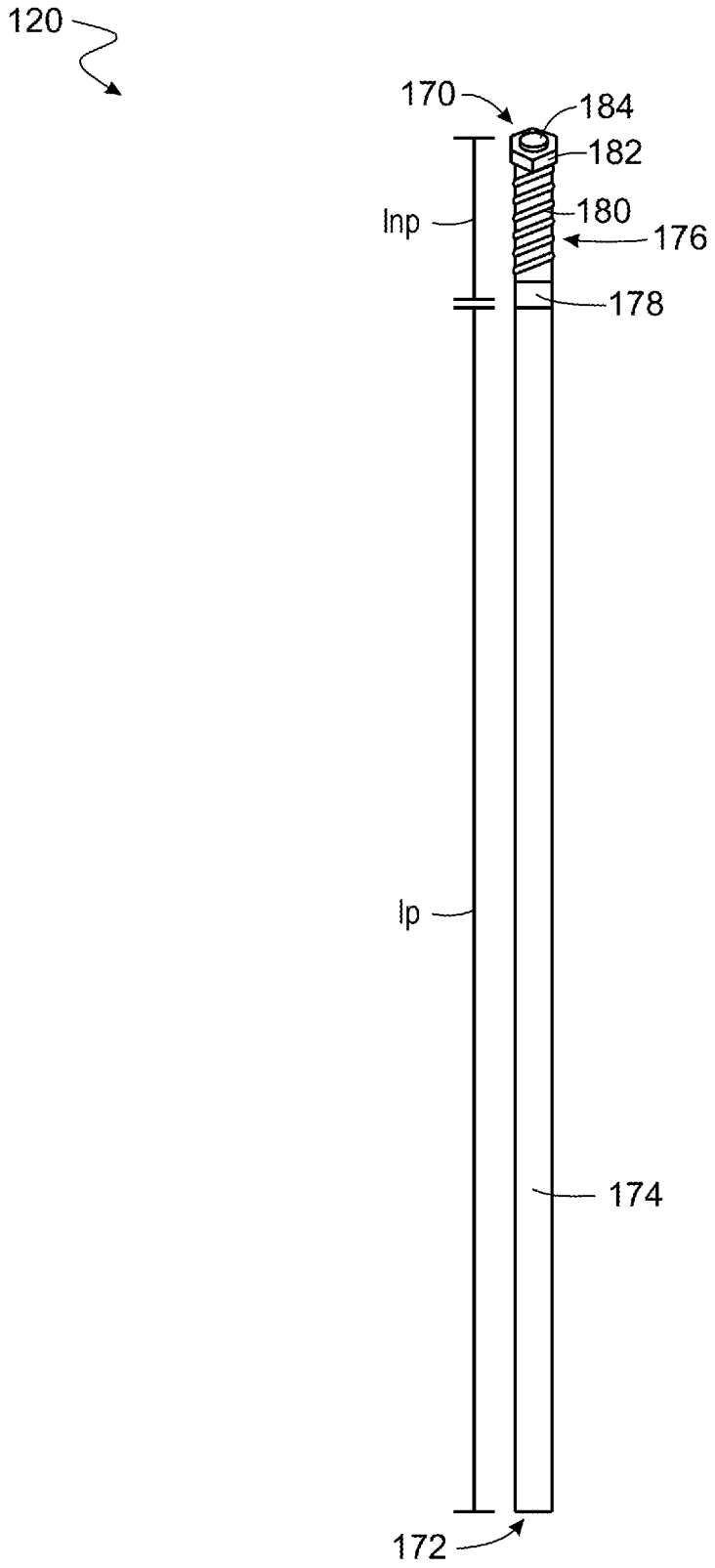
FIG. 5 is a cross front view of the rod with a smooth area and a textured area.

FIG. 5 is a front view of the lubricator rod 120 of the lubricator 102. In use, the lubricator rod 120 is arranged on or parallel with the axis 119. The lubricator rod 120 extends from an engagement end 170 (first end) to valve end 172 (second end). The engagement end 170 can releasably connect to a torque generator (e.g., a wrench) and the valve end 172 connects to the pressure valve 122 (e.g., a back pressure valve 122 (BPV or TWCV)) of the lubricator 102. The lubricator rod 120 includes a polished section 174 and a non-polished section 176. The polished section has a length $l_p$ and the non-polished section has a length $l_{np}$. The non-polished length $l_{np}$ is less than the polished length $l_p$. In use, the polished section 174 forms pressure seals with various proportional to the polished length, for example, about 5% to about 40% of the polished length (e.g., 5%, 10%, 15%, 20%, or 25% of the polished length). In use, the polished section 174 forms pressure seals with the seals 159 (FIG. 3B) in the first and second cavities 156, 158 of the yoke 130 (FIG. 3B). The seals 159 (FIG. 3B) maintain contact with the polished section 174 in operational use (e.g., as the lubricator rod axially translates and/or rotates), and in the open and closed positions of the lubricator housing 102.

The polished section 174 extends from the valve end 172 of the lubricator rod 120 towards the engagement end 170 of the lubricator rod 120. The non-polished section 176 extends from the engagement end 170 of the lubricator rod 120 towards the valve end 172 of the lubricator rod 120. In some cases, the non-polished section is arranged between the engagement end and the valve end of the lubricator rod.

The non-polished section 176 of the lubricator rod 120 includes a non-polished surface 178. The non-polished surface 178 is at least partially formed by a textured surface 180. The textured surface of the lubricator rod 120 can be threaded connection to polished section or can be manufactured as a union piece. In some cases, the on-polished surface section has a larger diameter or cross sectional area than the polished section of the lubricator rod. The textured surface can be or include a gritty texture or rubber to increase the static friction coefficient of the non-polished section. In use, the non-polished section can move along the axis between a location adjacent (above) the seal in the first cavity and a location in the interior bore at the second end of the barrel.

The lubricator 102 also includes a nut 182 with and hole 184 defined by an internal face (not shown). The internal face (not shown) is threaded (not shown) and mates with the threads 180 of the non-polished section 176 of the lubricator rod 120 and rotations relative to the rod 120 along the threads 180 until reaching a stopper 185. The stopper may be on or in the threads. In some cases, the stopper is at the termination of the thread (e.g., an end wall of the thread). After engaging with or reaching the stopper 185, the nut 182 is releasably connected to the lubricator rod 120 at the non-polished surface 178 and rotationally coupled to rod 120. In this configuration, the nut 182 transfers rotational and vibrational forces from an external machine, to the lubrication rod 120 and connected valve 122. For some cases hexagonal nut can be manufacture as a union piece (e.g., integral or permanently connected) without requiring any threading on the rod. Some devices include at least two nuts. In some cases, the nut can be attached to the lubricator rod after separating the barrel from the yoke.

In use, the lubricator rod 120 is slidably arranged in the aperture 146 of the yoke 132, the bore 134 of the barrel 130, and production tree 104. The non-polished section 176 of the lubricator rod 120 is aligned with or arranged in the interior bore 134 so that the separation of the barrel 130 from the yoke 132 exposes the non-polished section 176 of the lubricator rod 120. The nut 182 can engage with an external torque generator 206 (FIGS. 6B, 6C) to rotate the lubricator rod 120 and BPV 122 at the valve end 152 of the lubricator rod 120.

Some rods 120 include an engagement body integral with or fixed to the non-polished section rather than a threadedly engaged with the non-polished section. The engagement body can include a similar profile to a nut (e.g. hexagonal) or may be shaped to have a width greater than the width of the lubricator rod. the engagement body extends radially from the textured surface of the non-polished section. The engagement body is sized and shaped to mate with an external torque generator. The engagement body can include grooves and/or keyholes for receiving compatible torque generators. The engagement body can wholly or partially be a metal or composite materials for example, stainless steel (e.g., AISI—4130 Low Alloy Steel 75,000 psi).

Figure 6A:
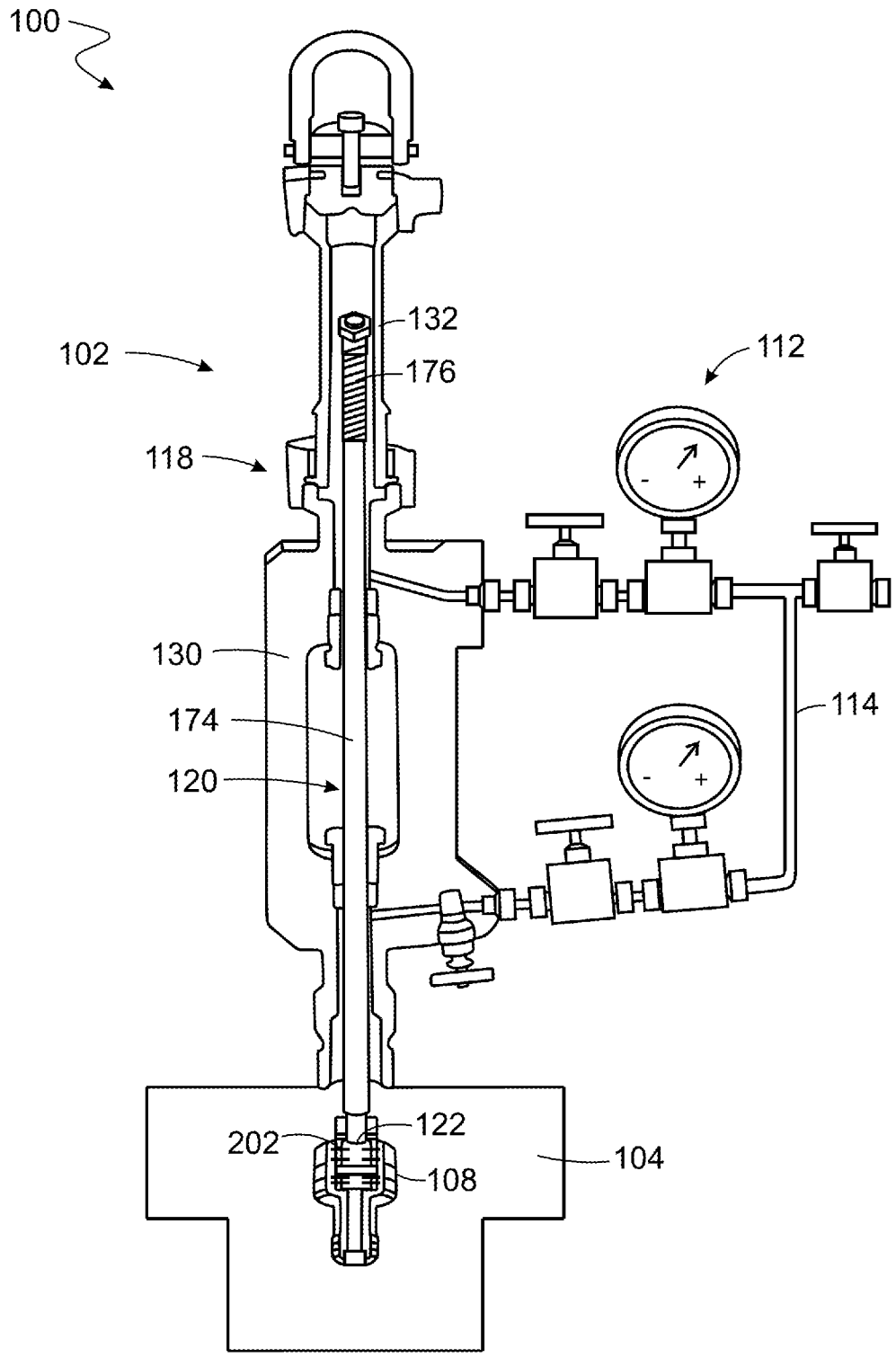
FIGS. 6A-D are cross-sectional views of the pressure containment system in use.

FIGS. 6A-D are cross-sectional views of the pressure containment system 100 in use. In FIG. 6A the lubricator rod 120 is arranged in the aperture 146 of the yoke 132 of the lubricator housing 118 and the bore 134 of the barrel 130 of the lubricator housing 118. The rod 120 also extends from the second cavity 128 of the aperture 146 of the yoke 132 into the production tree 104. The BPV 122 is connected to the valve end 172 of the lubricator rod 120 (e.g., by a polished rod adapter). The BPV 122 is engaged with the tubing hanger 108 and forms a seal with the tubing hanger 108, isolating the casing/tubing 111 from the production tree 104. Debris 202 has built-up between the tubing hanger 108 and the BPV 122. The debris 202 limits or inhibits the freedom of the BPV 122 rotationally and axially relative to the tubing hanger 108. In this configuration, the BPV/TWCV 122 is stuck within the production tree 104 and cannot be safely removed from the production tree 104. To release or dislodge BPV 122 from the tubing hanger 108, an operator or external machine decouples the Acme connection between the barrel 130 and the yoke 132 to separate the lubricator housing 118 and exposes the engagement end 170 of the lubricator rod 120.

Prior to decoupling and/or separating the lubricator housing 118, the needle valve arrangement 112 closes the needle valves to isolate the (high) pressure at the second end 118*b* of the lubricator housing 118 (e.g., below the window 160) from the pressure at the barrel 130 and/or at the first end 118*a* of the lubricator housing 118. In this configuration, a high pressure in the second end 116 of the lubricator 102 is maintained while the pressure at the first end 114 of the lubricator 102 is be bled off prior to disengaging the ACME connection.

Figure 6B:
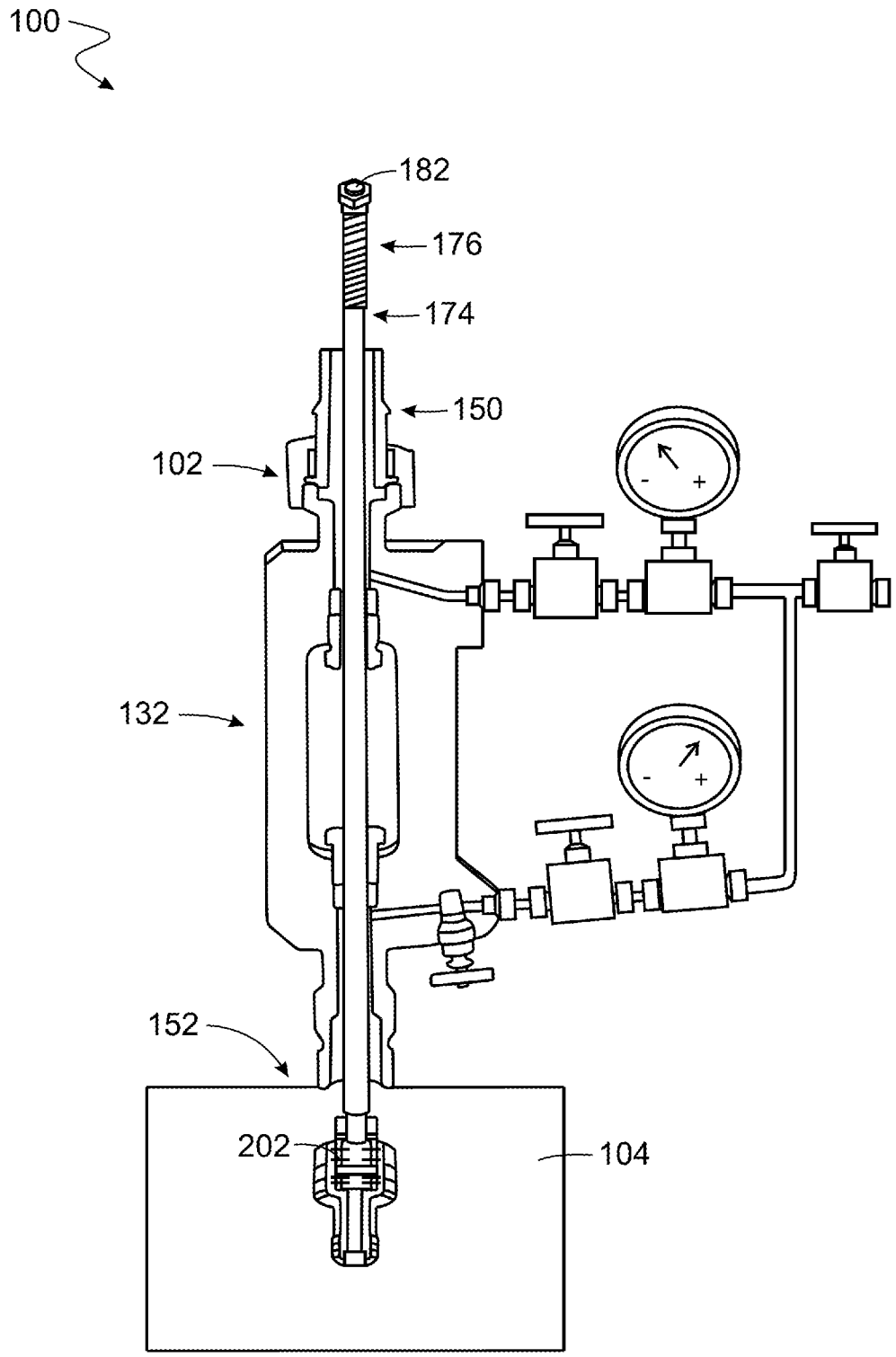

In FIG. 6B, the non-polished section 176 of the lubricator rod 120 is exposed after the barrel 130 is disconnected from the yoke 132 and axially distanced from the yoke 132. The user may attach a nut 182 to threads 180 of the non-polished section 176, forming an engagement body on the non-polished surface 178. In some systems, the non-polished surface includes an integral or fixed engagement body. In some systems, the textured surface of the non-polished section is an engagement surface that can be coupled to a torque generator. The system can include support struts 204 that are releasably attachable to the Acme threads of the yoke. A torque generating tool (e.g., a wrench, hydraulic torque machine, impact wrench machine, hydraulic torque wrench, or wrench sharp dies).

Figure 6C:
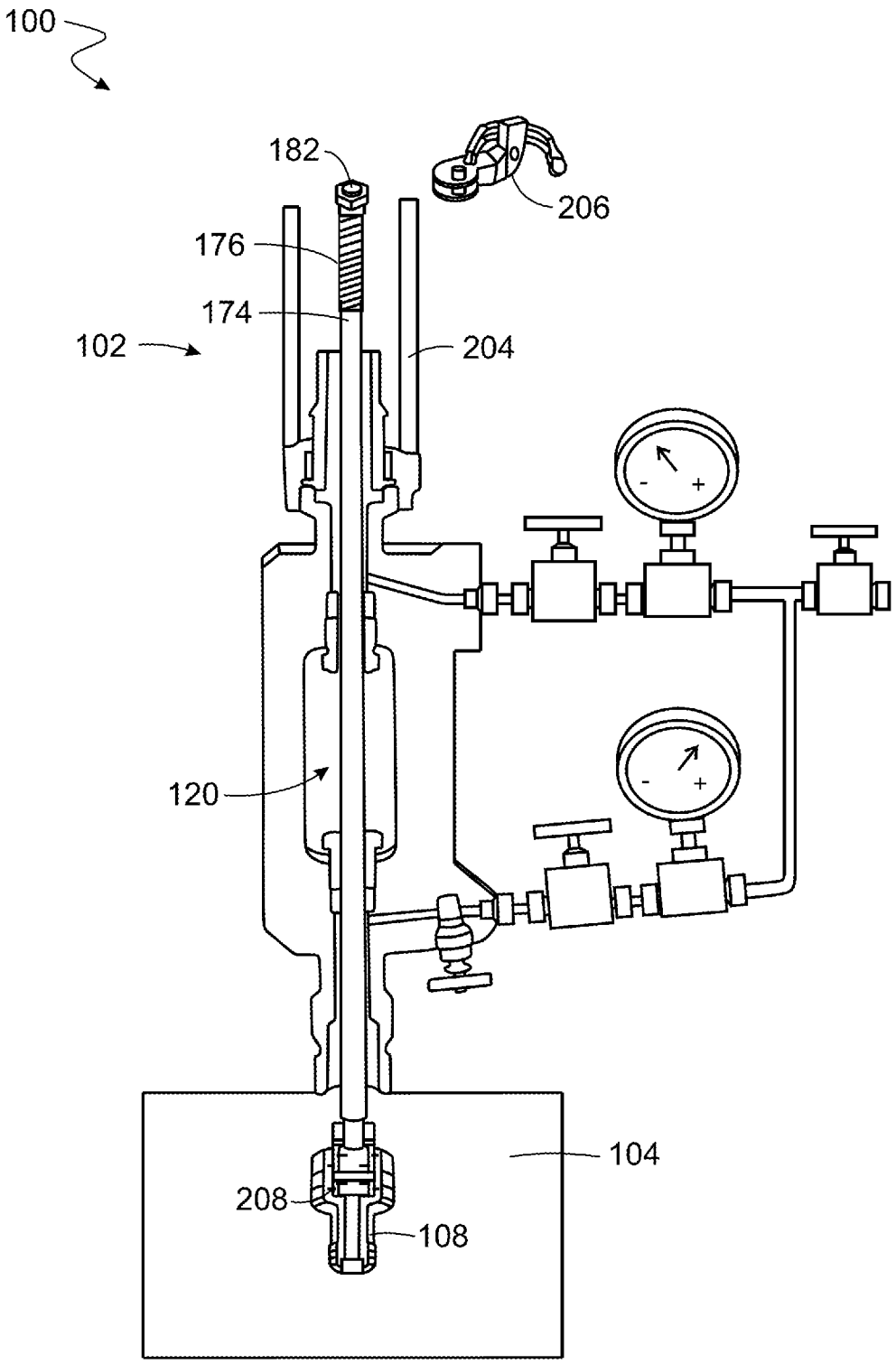

FIG. 6C is a cross-sectional front view of the system with the force generator mounted on support struts 204. The support struts 204 provide mechanical support and or a mountable structure for a torque generator 206. When the support struts 204 are engaged with the Acme threads up the yoke 132, at least a portion of the non-polished section 176 extends past the support struts 204. In the lubricator 102, the nut it's also exposed outside the support struts 204. For some cases support struts can connect directly to wellhead or production tree for higher supports.

The external torque generator 206 engages with the nut 182 and rotates the BPV 122 through rotation of the lubricator rod 120. The torque generator 206 applies a predetermined amount of rotational force to the nut 182, rod 120, and BPV 122 to rupture or sever the debris 208 from the BPV 122. The ruptured debris 208 does not prevent or inhibit axial movement of the BPV 122 relative to the tubing hanger 108.

In use, the external torque generator 206 rotates the BPV a fraction of a full (360 degrees) turn. For example the torque generator may rotate the BPV 122 $1/10^{th}$ of a turn, $1/5^{th}$ of a turn, $1/4^{th}$ of a turn, $1/3^{rd}$ of a turn, or ½ a turn, $2/3^{rd}$ of a turn, or ¾ths of a turn. In some systems, the lubricator rod 120 rotates at least one half of a full turn (180 degree turn), for example 1 turn.

Figure 6D:
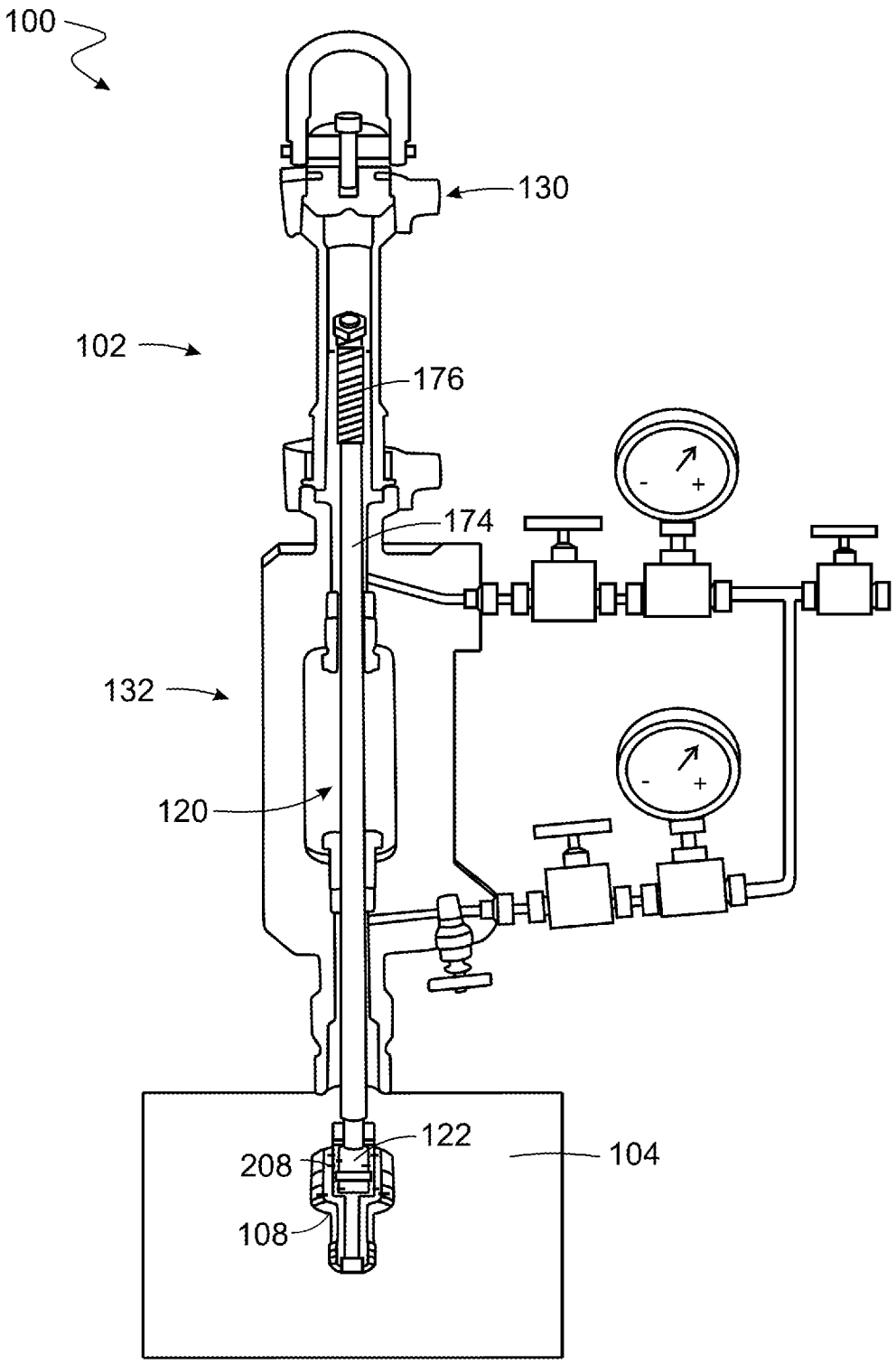

FIG. 6D is a cross-sectional front view of the dislodged BPV 122 and reconnected housing 118. The partial or full rotation of the BPV 122 ruptures the debris 208 and dislodges the BPV 122. After BPV/TWCV started to rotate upper part of the lubricator install again through ACME threads and establish pressure equalization to continue BPV/TWCV retrieving process. The torque generator and structs are removed and the barrel 130 is reconnected to the yoke 132 to unify the lubricator housing 118. The device can then be repressurized and the PBV 122 can be axially moved from contact with the tubing hanger 108. After reconnection of the barrel 130 by the ACME connection, the pressure at the second end 116 of the lubricator 102 will equalize between second end 116 and the first end 114. When the pressure are equalized, BPV/TWCV 122 can be retrieved safely.

The torque applied at the non-polished section of the lubricator rod can be generated by pipe wrench/hydraulic or pneumatic pipe tong dies While a torque generator has been described, some rods receive a vibrational force from a vibration generator. In some cases, the external torque generator applies torque and a vibrational force to the non-polished section of the lubricator rod.

A number of embodiments have been described. Nevertheless, it will be understood that various modifications may be made. Accordingly, other embodiments are within the scope of the following claims.

What is claimed is:

1. A pressure containment device comprising:

a separable lubricator housing comprising:

a barrel defining an interior bore extending from a proximal end of the barrel to a distal end of the barrel, and a yoke defining an aperture extending from a proximal end of the yoke to a distal end of the yoke; wherein the aperture defines an axis; wherein the interior bore is centered on the axis, wherein the proximal end of the yoke is releasably connected to the distal end of the barrel;

a lubricator rod slidably arranged on the axis in the interior bore of the barrel and in the aperture of the yoke; wherein the lubricator rod extends from a first end arranged in the interior bore to a second end extending out the aperture of the yoke; wherein the lubricator rod comprises:

a polished section, and a non-polished section, wherein the non-polished section is arranged in the interior bore of the barrel; and a pressure valve mounted to the second end of the lubricator rod.

2. The device according to claim 1, wherein the non-polished section extends from the first end of the lubricator rod.

3. The device according to claim 1, wherein the non-polished section is arranged between the first end and the second end of the lubricator rod.

4. The device according to claim 1, wherein the non-polished section comprises a textured surface.

5. The device according to claim 4, wherein the textured surface is a thread.

6. The device according to claim 1, further comprising a nut arranged on the non-polished section, wherein the nut is rotationally coupled to the lubricator rod.

7. The device according to claim 6, wherein the nut is configured to engage a torque generator.

8. The device according to claim 1, wherein the non-polished section comprises an engagement body, wherein the engagement body extends radially from a textured surface of the non-polished section.

9. The device according to claim 8, wherein the engagement body is configured to engage a torque generator.

10. The device according to claim 1, wherein the polished section of the lubricator rod is a first polished section, wherein the lubricator rod comprises a second polished section; wherein the non-polished section is arranged between the first polished section and the second polished section.

11. The device according to claim 1, wherein the barrel and the yoke are releasably connected by ACME threads.

12. The device according to claim 1, wherein the pressure valve is a back-pressure valve or a two way check valve.

13. A pressure containment system comprising:

a lubricator device comprising:

a lubricator housing comprising:

a barrel defining an interior bore extending from a proximal end of the barrel to a distal end of the barrel, and a yoke defining an aperture extending from a proximal end of the yoke to a distal end of the yoke; wherein the aperture defines an axis; wherein the interior bore of the barrel is centered on the axis, wherein the proximal end of the yoke is mounted to the distal end of the barrel;

a lubricator rod slidably arranged on the axis in the interior bore of the barrel and in the aperture of the yoke; wherein the lubricator rod extends from a first end arranged in the interior bore to a second end extending out the aperture of the yoke; wherein the lubricator rod comprises:

a polished section, and a non-polished section, wherein the non-polished section is radially aligned with the interior bore of the barrel; and a pressure valve mounted to the second end of the lubricator rod.

14. The system according to claim 13, wherein the proximal end of the yoke is releasably connected to the distal end of the barrel.

15. The system according to claim 14, wherein the lubricator housing has an open position and a closed position; wherein in the closed position the distal end of the barrel and the proximal end of the yoke are engaged; wherein in the open position, the distal end of the barrel and the proximal end of the yoke are disengaged.

16. The system according to claim 15, wherein in the open position, the barrel is axially distanced from the yoke.

17. The system according to claim 15, wherein in the open position, the non-polished section of the lubricator ro d is exposed.

18. The system according to claim 13, wherein the distal end of the barrel defines a first ACME thread; wherein the proximal end of the yoke defines a second ACME thread; wherein the first ACME thread and the second ACME thread are releasably mated.

19. The system according to claim 13, further comprising a torque generator; wherein the torque generator engages the non-polished section of the lubricator rod.

20. The system according to claim 13, further comprising a nut mounted on the non-polished section of the lubricator rod; wherein the nut is aligned with the interior bore of the barrel.

21. The system according to claim 20, wherein the nut is releasably mounted on threads defined in the non-polished section of the lubricator rod.

22. The system according to claim 13, further comprising a production tree having a tubing hanger and a well head; wherein the production tree is attached to the lubricator housing.

23. The system according to claim 13, further comprising a needle valve arrangement comprising:

a pressure tubing extending from the distal end of the yoke to the proximal end of the yoke, and at least one needle valve disposed on the pressure tubing; wherein the at least one needle valve is operable to isolate the distal end of the yoke from the proximal end of the yoke when the lubricator housing is in the open position.

* * * * *